US005705881A

United States Patent [19]

Friquet et al.

[11] Patent Number: 5,705,881

[45] Date of Patent: Jan. 6, 1998

[54] VERY HIGH POWER VACUUM ELECTRON TUBE WITH ANODE COOLED BY FORCED CIRCULATION

[75] Inventors: Olivier Friquet, Evian; Régis Combet, Thonon, both of France

[73] Assignee: Thomson Tubes Electroniques, Velizy, France

[21] Appl. No.: 446,310

[22] Filed: May 22, 1995

[30] Foreign Application Priority Data

May 27, 1994 [FR] France ..... 94 06464

[51] Int. Cl.[6] ..... H01J 7/26

[52] U.S. Cl. ..... 313/33; 313/22; 313/35

[58] Field of Search ..... 313/22, 23, 30, 313/33, 35, 36

[56] References Cited

U.S. PATENT DOCUMENTS 3,414,757 12/1968 Levin et al. .
3,845,341 10/1974 Addoms et al. .
4,988,910 1/1991 Gabioud ..... 313/22

FOREIGN PATENT DOCUMENTS 1 326 936 4/1963 France .
1 554 633 12/1968 France .
2 627 898 2/1988 France .

*Primary Examiner*—Sandra L. O'Shea
*Assistant Examiner*—Vip Patel
*Attorney, Agent, or Firm*—Oblon, Spivak, McClelland, Maier & Neustadt, P.C.

[57] ABSTRACT

The disclosure relates to very high power (one megawatt and more) electron tubes with cylindrical anodes. To cool the anode, which receives about one kilowatt per square centimeter, water is usually made to circulate in a jacket surrounding the anode with grooves to facilitate ebullition. The invention proposes a structure where the anode wall is drilled in its thickness and throughout its height with very fine and very numerous water circulation conduits. The anode is made in many superimposed sections brazed to one another by their edges. The conduits are formed in the individual sections before this brazing operation. The channels all lead into a structure for the distribution of cooling water which distributes the water uniformly in all the tubes. The anode can thus distribute a flux with power of over 2 kW/cm$^2$ on a surface area of over 1000 cm$^2$.

10 Claims, 3 Drawing Sheets

VERY HIGH POWER VACUUM ELECTRON TUBE WITH ANODE COOLED BY FORCED CIRCULATION

BACKGROUND OF THE INVENTION

1. Field of the Invention

The invention relates to very high power electron tubes of the tetrode type and especially of the triode type, having a radial structure, namely tubes wherein a cathode with a general cylindrical structure having a circular base sends out electrons radially towards an also cylindrical anode that surrounds the cathode and is coaxial with it. Electron extraction grids, which are also cylindrical, are interposed between the cathode and the anode.

The power values considered here are in the range of one megawatt for frequencies of several tens to several hundreds of megahertz. The voltage between the anode and the cathode is equal to several kilovolts.

The anode receives almost all the flow of electrons that is emitted by the cathode and modulated by the gate or gates. The kinetic energy of the electrons striking the anode is converted into heat. The power flux received by the anode is very high (in the order of magnitude of one kilowatt per square centimeter of surface area of anode for surface areas of several hundreds of square centimeters). Typically, for the type of electron tubes considered herein, the anode is a cylinder with a diameter of about 20 cm to 40 cm and a height of several tens of centimeters.

2. Description of the Prior Art

To cool the anode, water circulation systems have been devised. These are built in such a way as to give rise to the intensive formation of bubbles through the evaporation of the circulating water. The latent heat of water vaporization, which is high, is used to increase the effectiveness of the cooling. To facilitate the formation of ebullition zones, parallel and circular grooves are formed around the anode. The grooved anode is surrounded with a cylindrical jacket that canalizes the water in a narrow space between the exterior of the anode and the interior of the jacket, and a system of forced circulation of water between the bottom and the top of the anode is set up. A cooling system such as this is shown in FIG. 1 in the case of a triode.

The references of the drawing are as follows: anode 10; grooves 12; a first cooling jacket 14 surrounding the anode to canalize the water along the external wall surface of the anode; a second jacket 16 defining the water inlet chamber; the second jacket 16 surrounding the first one and communicating with it on one side, for example at the bottom of the anode, by an aperture 18; a pressurized water intake conduit 20 that opens into the second jacket; a conduit 22 for the removal of water and steam bubbles. The other elements of the figure are the standard elements of an electron tube: cathode 24 with its external connections 26 and 28 (for a cathode with direct heating); grid 30 with its external connection 32; anode connection 34 brazed to the base of the anode. All these connections are cylindrical and designed to be plugged into an adapted support that is not shown. The connections are separated by ceramic spacers 36. The enclosure demarcated by the internal wall surface of the anode, the internal wall surfaces of the connections and the ceramic spacers is under vacuum. The cooling jackets are not under vacuum.

The grooves machined on the external wall surface of the anode are used, as stated, to foster the appearance of points of evaporation of the water that flows under pressure. It is the most efficient form of cooling known to date (it is known as the hypervapotron system). The patent FR-A-2 627 898 describes such a tube.

However, a defect has been observed in this system: the bubble-formation grooves act against the discharging of these very same bubbles. The bubbles strike one another and coalesce and give rise to cases of localized excess pressure and sudden release of pressure by the implosion and disappearance of these bubbles in the current of water. This results in shocks and vibrations that are unacceptable for the flimsy and non-rigid elements of the tube, notably the grids which are very close to the cathode and risk touching it or touching one another.

The patent U.S. Pat. No. 3,414,757 has also already proposed a klystron with a power of 100 to 200 kW, whose collector is formed by an axial succession of sections of tubes brazed to one another by a seam of brazing alloy. Each tube is drilled on its circumference with axial, cylindrical conduits used for the cooling of the collector by water.

It can be seen that the construction envisaged cannot be used to obtained substantially higher power values, namely values of about one megawatt, as is desired in the present invention.

SUMMARY OF THE INVENTION

One aim of the present invention is to seek means for the dissipation, on the anode, of power far higher than that enabling the construction of the collector of the patent U.S. Pat. No. 3,414,757 and far higher than that enabling the construction of the device of the patent FR-A-2 627 898. The magnitude sought is a doubling of the power values with respect to those provided by the latter patent, which is considerable.

According to the invention, there is proposed a very high power vacuum electron tube having a cylindrical anode (namely an anode whose internal wall surface area is essentially cylindrical in its active part facing an also cylindrical tube) formed by at least one cylindrical section (i.e. here too with an internal wall surface that is essentially cylindrical, at least at the place where this wall surface faces a corresponding cathode portion) and preferably several cylindrical sections superimposed coaxially and brazed to one another, the wall of each section being drilled with several longitudinal conduits for the circulation of cooling fluid extending linearly throughout the height of the section, wherein the longitudinal conduits all lead, at one end of the anode, preferably in the upper part of this anode, into a structure for the distribution of cooling water uniformly supplying all the longitudinal conduits that lead into this upper part.

This structure makes it possible notably to preserve as high a speed as possible of the water in all the conduits, and a very high uniformity of cooling.

The distribution structure is preferably conical and without load losses.

The conduits have a section that is completely circular (and closed) and extend linearly throughout the height of the anode (preferably in a direction strictly parallel to the axis of the cylindrical anode). They are therefore not open rectangular grooves formed by the machining of the external wall surface of the anode and then closed by an external jacket. The cooling efficiency is thereby considerably improved, all the more so as it is furthermore provided that the drilling of the conduits is done closer to the internal wall surface of the anode than to the external wall surface of the anode.

In view of the very high quantities of heat received by the anode, it is thought that cooling conduits with rectangular sections would permit zones of excess heat, fatal to the power tube, to remain. These zones of excess heat are the corners of the rectangular section, where the cooling water circulates less well.

An observation will be made here: in the tubes of the type described here (with a circular cylindrical anode and power values of the order of one megawatt or more), the anode has a height of several tens of centimeters. It is difficult to form circular drillings parallel to the axis of the anode (it is not possible to make drillings that are both very long and very fine, and they must be made fine if it is desired to juxtapose a sufficient number of them to cool the entire anode wall surface uniformly). Preferably, therefore, several cylindrical anode sections are superimposed after they have been drilled with very fine conduits, the conduits being placed so as to face each other to reach longitudinal conduits throughout the height of the anode. The diameter of the conduits may then be very small (diameter at least 30 times smaller, and preferably at least 40 or 50 times smaller than the height of the anode).

According to another important aspect of the invention, the cylindrical anode is formed by cylindrical copper sections that have silvered edges and are brazed to one another by their silvered edges without any depositing of brazing material other than the silvering of the edges, so that there is no parasitic running out of brazing material. And of course, if the anode has very fine linear conduits that open out into positions where they face each other on the edges of the adjacent cylindrical sections, there are thus avoided the risks of the running out of brazing material that could at least partially plug the conduits and that cannot be cleaned out in view of the fineness of the conduits.

Consequently, a major aspect of the invention is the operation of brazing by silvering (electrolytic deposition in principle) of the edges of the individual cylindrical sections, and then the superimposition of these edges in an oven in temperature and atmospheric conditions capable of forming a silver brazing between the silvered edges in contact.

According to another general aspect of the invention, the cylindrical anode is drilled with fine conduits parallel to the axis of the anode and closer to the internal surface of the anode wall than to the external surface of this wall.

Finally, it is important to note that, unlike in the case of the tubes conventionally cooled by the creation of the steam bubbles, in which the water is made to circulate in the direction in which the bubbles tend to leave (hence upwards), it is preferably chosen here to lead in the water by the top of the tube. The structure is such that the speed of flow is high in the conduits and the bubbles are carried along swiftly downwards without the circulation of water countering the circulation of the bubbles.

BRIEF DESCRIPTION OF THE DRAWINGS

Other features and advantages of the invention shall appear from the reading of the following detailed description, made with reference to the appended drawings, of which.

MORE DETAILED DESCRIPTION

Figure 1:
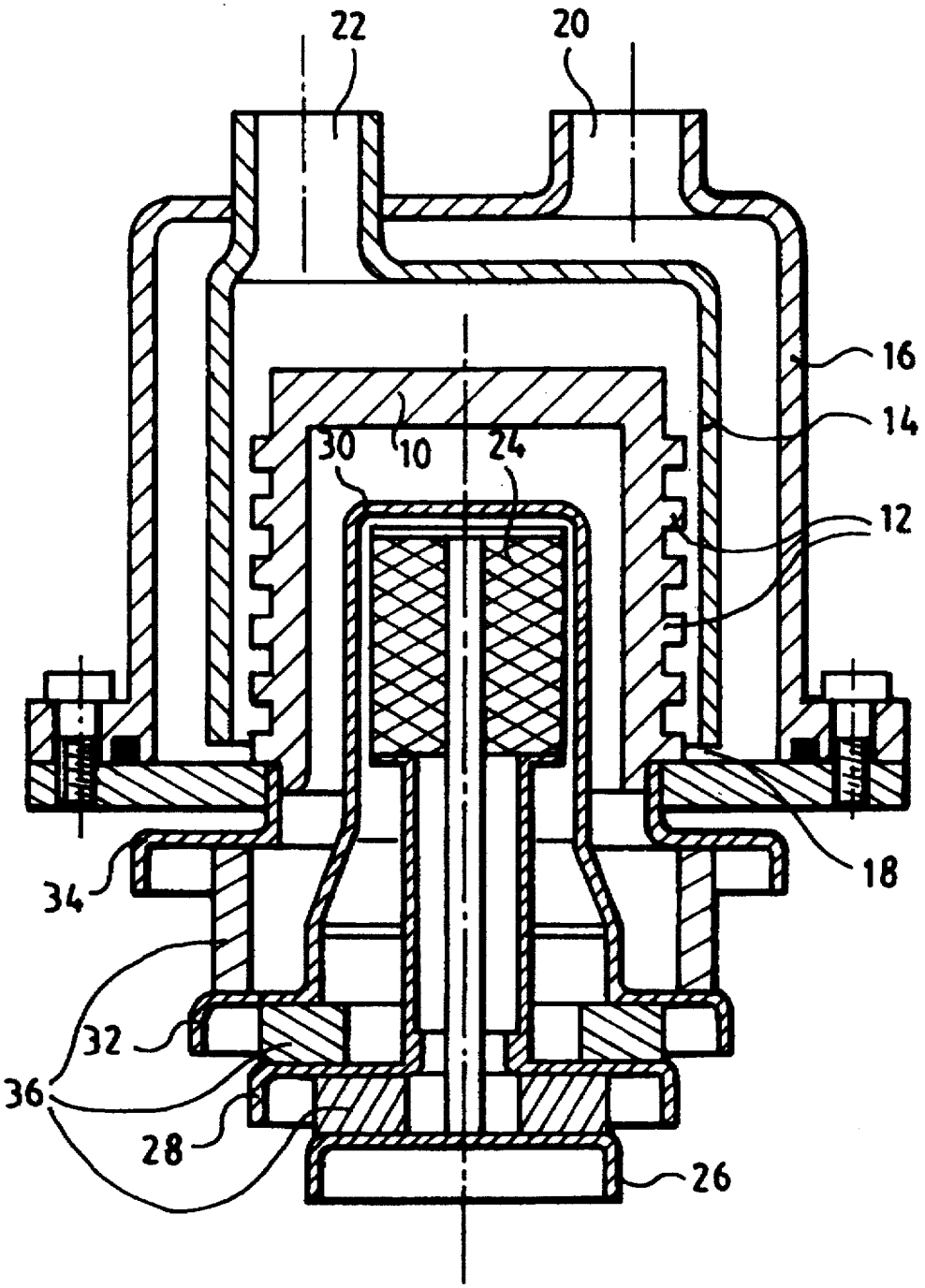
FIG.1 PRIOR ART
FIG. 1 already described shows a prior art high power tube with its cooling system.
Figure 2:
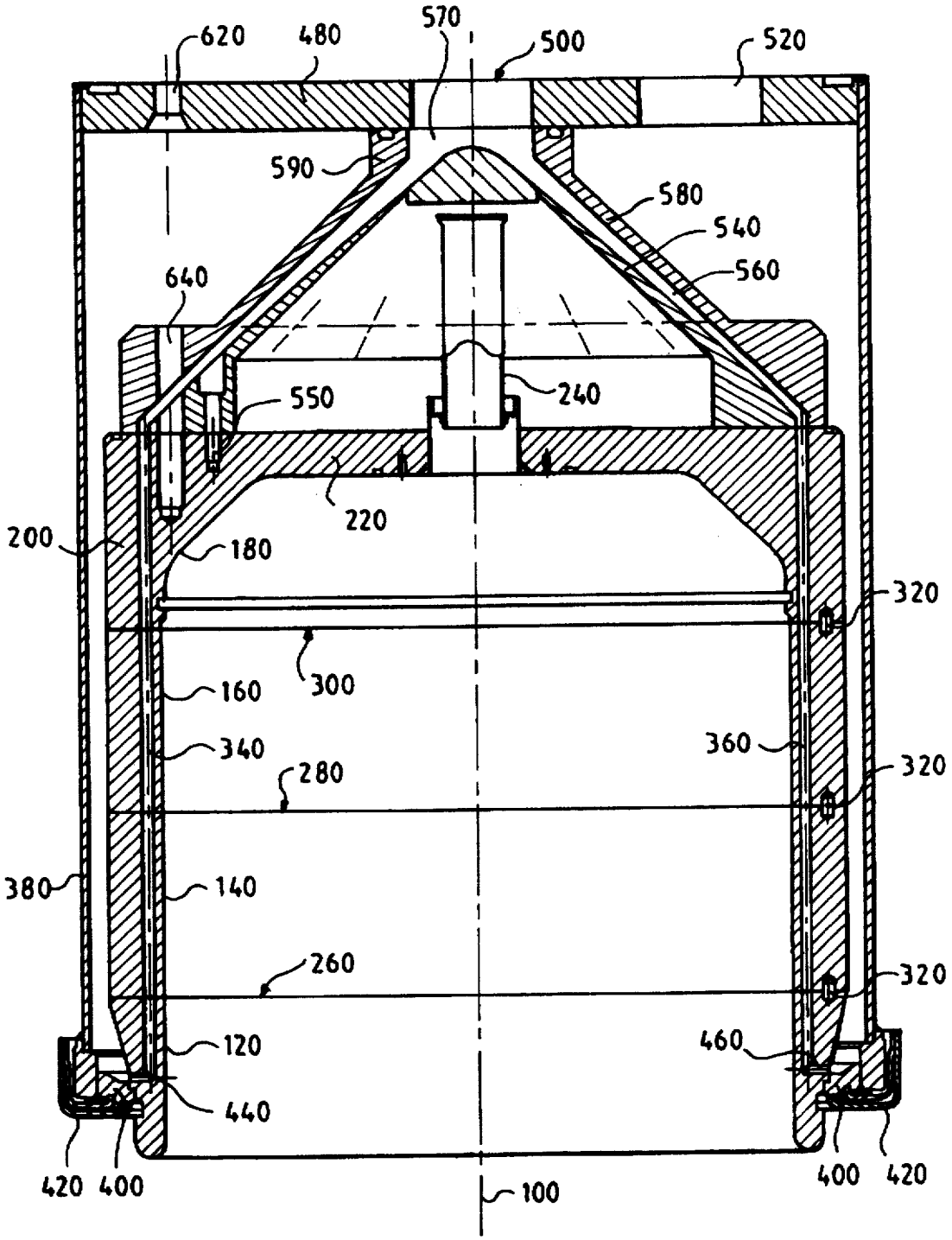
FIG. 2 shows an axial section of the cylindrical anode of a tube according to the invention.

FIG. 2 shows the anode of a power tube according to the invention, with its cooling system. The other elements of the tube (cathode, grids, external connections, ceramic spacers providing for vacuum tightness) are not shown in order to avoid burdening the figure and may, if desired, be similar to those of FIG. 1.

The body of the anode is conventionally formed on the whole by a cylinder generated by revolution having an axis 100. This cylinder is open in its lower part and closed in its upper part. The upper part essentially has the shape of a disk transversal to the axis 100, provided with an evacuation stem.

The anode is formed by several superimposed sections. Each section is formed by a totally cylindrical section, the upper section being however constituted both by a cylindrical section and by the upper closing disk of the anode.

In the example shown, there are four coaxially superimposed cylindrical anode sections 120, 140, 160, 180. The upper section 180 is divided into a cylindrical part 200 and the closing disk 220. The evacuation stem is designated by the reference 240. It is placed at the center of the disk 220. It is designed to be closed hermetically after the vacuum has been set up in the tube.

Each section comprises a cylindrical wall (with an internal wall surface and an external wall surface), and two end edges, respectively an upper edge and a lower edge. The edges are plane (plane perpendicular to the axis 100 of the tube). The anode sections are brazed to one another by their facing edges, i.e. the lower edge of a section is brazed to the upper edge of a section located immediately below; the planes of these edges are designated by the references 260, 280, 300. Thus, for example, the plane 280 is the brazing plane of the lower edge of the section 160 and of the upper edge of the section 140. Centering pins 320 are provided on these planes, to position the different sections exactly with respect to one another. The exact positioning is necessary both to provide for an exact coaxial centering of the sections and to ensure, as shall be seen further below, for the alignment of the cooling conduits of the different sections. Several centering pins 320 are planned in each brazing plane, only one being shown in FIG. 2 in each plane. The pins are, for example, small vertical cylinders inserted in facing bores formed in the edges of two adjacent sections.

The anode has rectilinear cooling conduits extending throughout the height of the anode. Two conduits 340 and 360 can be seen in FIG. 2. They are the conduits which are in the axial section plane of the vacuum tube. The conduits are drilled in the thickness of the wall of the sections. They are as numerous and as fine as possible so as to cool the entire wall of the anode as uniformly as possible. Their diameter is equal, for example, to some millimeters (with a section of some square millimeters to some tens of square millimeters), and they are very close to each other, with a spacing also of some millimeters. For example, a diameter of 3 to 5 millimeters and a spacing of 2 to 5 millimeters between conduits constitute preferred dimensions. In one exemplary embodiment, there are about 160 conduits distributed in a ring all around the anode with a diameter of about thirty centimeters. The diameters and spacings are then equal to about 3 mm.

Figure 3:
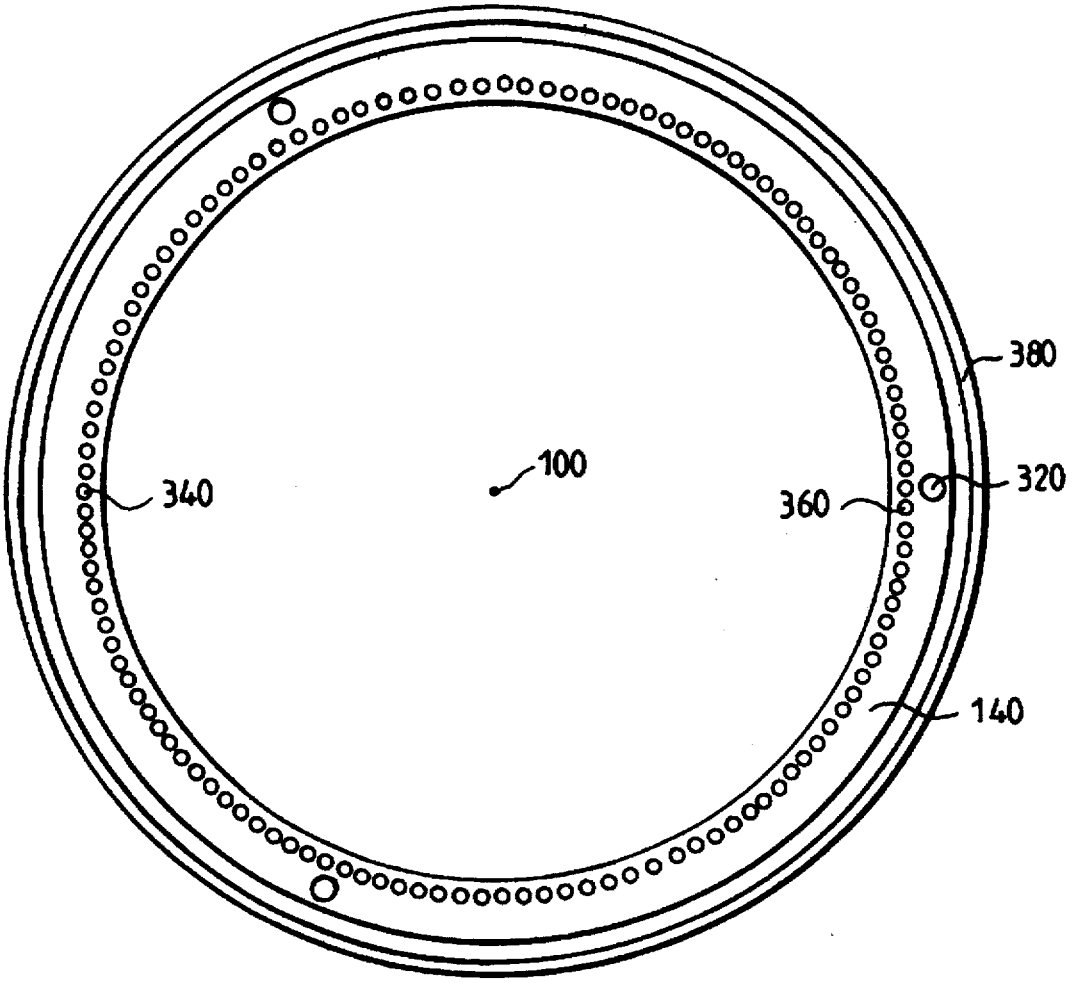
FIG. 3 shows a cross-section of the anode, perpendicularly to the axis of this anode.

The conduits are preferably circular-sectioned drillings, for the circulation of the cooling fluid (in principle pressurized water) is then optimal. If there were corners, there would be the risk that the fluid might cool the corners inefficiently. As can be seen in the figure, the rectilinear conduits are closer to the internal wall surface of the anode than to the external wall surface. The space between the edge of a conduit and the internal wall surface of the anode may be equal to some millimeters, for example 3 to 5 millimeters. The thickness of the anode wall may be 15 to 30 millimeters. The cooling is therefore done more efficiently in making the water circulate closer to the internal wall surface where the release of heat takes place. The conduits are distributed evenly in a ring all around the anode. The centering pins 320 are preferably located outside this ring so as not to hamper the even distribution of the conduits around the anode. FIG. 3 shows a sectional view, crosswise with respect to the axis 100, of one of the brazing planes, and this ring of conduits is seen therein.

In practice, it may be considered that the conduits are placed in the vicinity of the internal surface of the wall of the anode, at a distance from this surface approximately equal to the diameter of the drillings, and the drillings are distributed all around the anode in being separated from one another by a distance approximately equal to their diameter.

The height of the anode is equal to several tens of centimeters. For these heights, it would be practically impossible to drill circular holes with a drill having a diameter of some millimeters. This is one of the reasons why the anode is formed by several brazed sections: the height of each section is chosen so as to be compatible with the practical possibility of drilling fine holes at this height. In practice, it is possible to drill holes at a height that does not exceed 20 or 25 times the diameter of the hole. For holes with a diameter of 3 to 5 millimeters, anode sections with a height of not more than 10 centimeters will be superimposed. Since the height of the anode is substantially greater than 30 times the diameter of the conduits, and even greater than 40 or 50 times this diameter, several superimposed anode sections are necessary.

Rectilinear conduits are therefore drilled in each section at perfectly defined positions so that the conduits of the different sections face each other exactly when the sections are superimposed and positioned by the centering pins 320.

The cooling conduits open into the upper part of the upper section 180. They form a ring of apertures and the cooling water will be distributed in these apertures by a fluid-inlet conical structure which shall be referred to here below.

At the base of the anode, the removal of the heated water is done preferably by recovery in a cylindrical jacket 380 surrounding the anode. There is only one jacket and not two jackets as was the case in the prior art. The water recovery configuration is, for example, the following: radial holes are drilled all around the external surface of the wall of the lower section 120 and make the downstream end of each vertical conduit communicate with the exterior of the anode wall. Two radial holes, 440, 460 can be seen in FIG. 2. These are the holes that are in the sectional plane of the figure and communicate with the conduits 340 and 360 respectively. The jacket 380 constitutes a space for the confinement of water. It is closed in its lower part by a ring 400. In the example shown, the anode connection 420 takes support on this ring. The cylindrical jacket 380 is furthermore closed in its upper part by a plate 480 in which there is provided a water-inlet aperture 500 and a water-removal aperture 520.

The conical structure for the distribution of pressurized water is placed inside the jacket 380 so that the water arrives from the aperture 500, passes into the conical structure without leakage towards the interior of the jacket 380 and then passes into the cooling conduits in the thickness of the anode wall, and finally rises by the jacket 380 up to the removal aperture 520.

For this purpose, the conical structure is constituted as follows: a conical block 540 that is hollow (because of the presence of the evacuation stem 240) is mounted on the closing disk 220 of the anode. This block 540 is screwed into the anode (threaded bores 500 provided in the terminal section 180) after the vacuum has been made in the tube and after the evacuation stem has been definitively closed. The external wall surface of the block 540 is conical and defines a first surface for the demarcation of a conical channel 560 along which the water flows (from the top to the bottom), namely from the inlet aperture 500 to the opening orifices of the cooling conduits such as 340 and 360).

A second block 580, whose internal wall surface is conical, defines a second surface for the demarcation of the channel 560. The top of the block 580 comprises a central conduit 570 whose peripheral edge 590 is applied to the internal surface of the closing plate 480 around the aperture 500, so that the water brought under pressure into this aperture is forced into the conical channel 560 between the conical surfaces of the two blocks 540 and 580. The aperture 580 is preferably formed at the center of the plate 480 to be in the axis of the anode, the conical blocks being also in the axis of the anode.

The channel 560 may have an annular section that narrows down continuously from the top to the bottom of the conical structure, i.e. the angle of conicity of the internal wall surface of the block 580 is preferably smaller than the angle of conicity of the external wall surface of the block 540.

The internal surface of the block 540 and/or the external surface of the block 580 could be machined so as to gradually form juxtaposed channels distributed in the form of a ring, each channel opening out into a position where it faces a respective rectilinear conduit of the anode, but this is not obligatory: the surfaces of the blocks 540 and 580 may be smooth. In the latter case, there is a certain load loss at the place where the continuous annular channel meets the discontinuous apertures of the conduits of the anode, but this load loss is not very great.

The upper conical bloc 580 may be screwed into the lower block 540, for example by eight bolts distributed around the structure, penetrating threaded bores formed in the upper section 180 of the anode. In the example shown, the upper conical block is not screwed in but is simply gripped between the upper closing plate 480 of the jacket 380 and the upper disk of the anode. Clamping bolts pass through apertures 620 of the plate 480, and then into apertures 640 of the conical block, and are screwed into the bores.

A pressurized water inlet system (not shown) is connected to the aperture 500 of the upper plate 480.

The method of manufacture of this anode consists in making the different cylindrical sections 120, 140, 160, 180 separately by machining different blocks of copper separately. The internal and external wall surfaces of the sections are machined to the desired shape and dimensions so that the sections can subsequently be superimposed axially and then form the complete anode as desired. The drillings of the rectilinear conduits are made in the wall of each section, as are the holes that have to receive the centering pins 320. The diameters of the conduits are in practice at least one-twentieth of the height of the cylindrical section in which they are drilled (below this value, the drilling becomes very difficult and even impossible). This diameter is however at least forty or fifty times smaller than the total height of the anode. The positions of the centering holes and conduits are perfectly defined with respect to one another so that the conduits face one another during the superimposition of the sections. The edges are then machined so as to be perfectly plane and perpendicular to the axis of the cylinders. The edges designed to be juxtaposed with another edge are then silvered by electrolytic methods. The sections are superimposed on one another without any deposit of brazing material between two adjacent sections, with only the very thin electrolytic deposit constituting the brazing material. The unit formed by axially superimposed sections is placed in an oven at sufficient temperature (about 820° C.), preferably in a reducing atmosphere, to form a silver-based brazing alloy between the adjacent sections. The brazing is actually a diffusion of silver in copper which leads to the formation of an eutectic compound Ag/Cu at 780° C. A final machining (turning) of the tube may be done to adjust the internal and external wall surfaces of the anode.

Finally, in a standard way, the other electrodes (cathode, grids) are mounted with their connections and the vacuum-tight ceramic spacers (metal/metal and metal/ceramic brazing). Then, the vacuum is made inside the tube. Finally, the conical structure for the inlet of cooling water and the jacket for water recovery are mounted.

During operation, the electron tube according to the invention can take a level of power dissipation that exceeds 2 megawatts, and even 2.5 megawatts (2 $kW/cm^2$ on a surface area of more than 1000 $cm^2$). The water is led in under pressure by the inlet conduit 500 and it circulates at high speed in the fine conduits of the anode. It is taken to high temperature and starts boiling. The steam bubbles that form are immediately removed by means of the high speed of circulation of the water, unlike in prior art cooling systems where, in order to foster the formation of bubbles, obstacles (grooves) were placed, obligatorily slowing down the circulation of water. The cooling is considerably improved by this speedy removal of water and bubbles. The conical structure for the inlet of water, which distributes the water uniformly without deliberate load loss to ensure this uniformity, also improves the speed of flow and hence the cooling. The cooling is improved also by the fact that the conduits have a circular section and not a rectangular or square section. It is improved by the fact that the conduits are not placed around the anode but in the very wall of the anode, and furthermore closer to the internal wall surface than to the external wall surface. The cooling is further improved by the fineness of the channels (which enables a very large number of channels to be placed very close to one another), this fineness being made possible in this case by the making of the anode in several sections that are brazed to one another.

The operation of brazing without any deposit of brazing material but simply with a thin electrolytic layer of silver forming an integral part of the anode sections makes it possible to avert any running out of brazing material at undesirable places. Indeed, when two parts are soldered together by the insertion of a brazing seam between the two parts, there are two risks. First of all, there is the risk of the running out of the material while it melts, causing the presence of brazing material at undesirable places. It would be undesirable, for example, for the brazing material to flow into the fine conduits, risking their partial or total obstruction and therefore causing a local absence of cooling that would be detrimental to the tube. Secondly, there is the risk that the running out of brazing material might lead to an absence of brazing material at certain places. In this case, there would be no vacuum tightness at these places. In the case of the invention, the regions that have to ensure the vacuum tightness have a width of some millimeters (for example between a cooling conduit and the internal wall surface of the anode). A running out of brazing material could create a local lack of brazing, causing an irremediable defect of vacuum tightness. With the method according to the invention, without added-on brazing material, this risk is eliminated.

What is claimed is:

1. A high power vacuum electron tube with an essentially cylindrical anode, wherein the anode is formed by at least one generally cylindrical section, a cylindrical wall of each of said at least one generally cylindrical section having a plurality of drilled longitudinal conduits symmetrically distributed around each cylindrical section for the circulation of cooling fluid said plurality of conduits extending linearly throughout the height of the section, wherein each of the longitudinal conduits lead, at one end of the anode, into a structure for the distribution of cooling water which is uniformly supplied to each of said plurality of longitudinal conduits that lead into said structure.

2. A tube according to claim 1, wherein the anode has several axially superimposed cylindrical sections brazed to one another, each conduit of one section exactly facing a corresponding conduit of an adjacent section.

3. A tube according to one of the claims 1 and 2, wherein the structure for the uniform distribution of cooling water is placed in the upper part of the anode.

4. A tube according to one of the claims 1 to 2, wherein the conduits are drilled in the thickness of the wall of the anode, closer to the internal surface of this wall than to the external surface.

5. A tube according to one of the claims 1 or 2, wherein the conduits have a section ranging from some square millimeters to some tens of square millimeters, the height of the anode being equal to some tens of centimeters.

6. A tube according to one of the claims 1 to 5, wherein the conduits are circular-sectioned drillings placed in the vicinity of the internal surface of the wall of the anode, at a distance from this surface approximately equal to the diameter of the drillings, and the drillings are distributed all around the anode in being separated from one another by a distance approximately equal to their diameter.

7. A vacuum electron tube according to one of the claims 1 or 2, wherein the conduits are very fine circular drillings with a diameter that is at least thirty times and preferably at least forty to fifty times smaller than the height of the anode.

8. An electron tube according to one of the claims 1 or 2, wherein the cooling water distribution structure is a conical structure.

9. A tube according to claim 8, wherein the conical surface comprises a first block having a wall with a conical external surface and a second block having a wall with a conical internal surface surrounding the first block, so as to form a channel for the circulation of water between these walls, the longitudinal conduits being located between the two conical walls at the base of these walls, and an inlet of pressurized water being designed in the upper part of the channel formed between the conical walls.

10. An electron tube according to one of the claims 1 or 2, wherein the anode is surrounded by a jacket for the recovery of cooling fluid, the downstream end of the longitudinal conduits for the circulation of fluid communicating with the jacket.

* * * * *